US007357366B1

(12) United States Patent
White et al.

(10) Patent No.: US 7,357,366 B1
(45) Date of Patent: Apr. 15, 2008

(54) SPORTS POLE MOUNTING STRUCTURE

(75) Inventors: Ronald White, North Prairie, WI (US); Jeff Breitzman, Sussex, WI (US)

(73) Assignee: Russell Corporation, Atlanta, GA (US)

( * ) Notice: Subject to any disclaimer, the term of this patent is extended or adjusted under 35 U.S.C. 154(b) by 52 days.

(21) Appl. No.: 10/691,965

(22) Filed: Oct. 24, 2003

(51) Int. Cl.
*F16M 13/00* (2006.01)

(52) U.S. Cl. ..... 248/520; 248/156; 52/169.13; 473/433

(58) Field of Classification Search ..... 248/518, 248/519, 529, 530, 533, 156, 230 S; 52/169.13, 52/165, 297, 298, 170; 473/433, 479, 481
See application file for complete search history.

(56) References Cited

U.S. PATENT DOCUMENTS

| | | | | | |
|---|---|---|---|---|---|
| 87,015 | A | | 2/1869 | Varian | |
| 225,683 | A | | 3/1880 | Brady | |
| 405,658 | A | | 6/1889 | Campany | |
| 432,043 | A | | 7/1890 | Heiland | |
| 592,660 | A | | 10/1897 | Miller | |
| 611,568 | A | | 9/1898 | Dohme | |
| 683,270 | A | * | 9/1901 | Geiger | 52/297 |
| 753,709 | A | | 3/1904 | Jones | |
| 837,820 | A | | 12/1906 | Folsom et al. | |
| 877,268 | A | | 1/1908 | Van Buren | |
| 982,380 | A | | 1/1911 | Martin | |
| 1,095,197 | A | | 5/1914 | Entemann | |
| 1,309,806 | A | | 7/1919 | Medart | |
| 1,409,155 | A | | 3/1922 | Covan | |
| 1,536,559 | A | * | 5/1925 | Carroll | 52/297 |
| 1,564,109 | A | | 12/1925 | Ponsolle | |
| 1,611,935 | A | | 12/1926 | Mitchell | |
| 1,735,722 | A | | 11/1929 | Beard | |
| 1,799,314 | A | | 4/1931 | Pfaff | |
| 1,982,569 | A | * | 11/1934 | Byrd | 52/298 |
| 1,991,087 | A | * | 2/1935 | Falcon | 52/297 |
| 2,194,779 | A | | 3/1940 | Albach | 273/1.5 |
| 2,210,441 | A | * | 8/1940 | Bachman | 52/297 |
| D139,311 | S | | 10/1944 | Gibson | |
| 2,469,494 | A | * | 5/1949 | Bushko | 211/172 |
| 2,564,065 | A | * | 8/1951 | Jaden | 248/533 |
| 2,888,111 | A | | 5/1959 | Evans | 189/26 |
| 2,945,659 | A | | 7/1960 | McDonald | 248/156 |

(Continued)

FOREIGN PATENT DOCUMENTS

| | | |
|---|---|---|
| SE | 315382 | 4/1969 |

OTHER PUBLICATIONS

Installation instructions and product description for a ground sleeve sold by Lifetime Products, Model #0023, 2 pgs.

(Continued)

*Primary Examiner*—Korie H. Chan
*Assistant Examiner*—Steven Marsh

(57) ABSTRACT

A sports pole mounting structure for supporting sports equipment in a pool environment capable of repeated assembly and removal. The mounting structure includes a bracket and a collar securely engaging existing in-ground sleeves traditionally found around pool environments and supporting sports equipment for use in a pool. The bracket is configured such that the sports pole is prohibited from rotating in the in-ground sleeve and the combination of the bracket and collar is capable of use with in-ground sleeves of varying size and shape.

8 Claims, 5 Drawing Sheets

U.S. PATENT DOCUMENTS

| | | | | | |
|---|---|---|---|---|---|
| 3,170,721 | A | | 2/1965 | Wells et al. | 287/126 |
| 3,339,869 | A | | 9/1967 | Anderson | 248/48 |
| 3,342,444 | A | | 9/1967 | Nelson | 248/156 |
| 3,385,565 | A | * | 5/1968 | Cuthbert | 256/13.1 |
| 3,417,525 | A | | 12/1968 | Dashio | 52/160 |
| 3,466,715 | A | * | 9/1969 | McCarthy | 24/700 |
| RE26,779 | E | * | 2/1970 | Weichenrieder | 116/63 R |
| 3,544,110 | A | | 12/1970 | Dickinson | 273/1.5 |
| 3,598,406 | A | | 8/1971 | Robinson | 272/61 |
| 3,602,505 | A | | 8/1971 | Friend | 273/1.5 R |
| 3,612,287 | A | | 10/1971 | Maltese | 211/86 |
| 3,767,355 | A | | 10/1973 | Anderson | 431/295 |
| 3,843,079 | A | | 10/1974 | Reisling | 248/44 |
| 4,133,154 | A | | 1/1979 | Ruzicka | 52/298 |
| 4,307,887 | A | | 12/1981 | Weiss | 273/411 |
| 4,522,394 | A | | 6/1985 | Broussard | 273/1.5 R |
| 4,697,779 | A | * | 10/1987 | Guislain | 248/530 |
| 4,896,651 | A | | 1/1990 | Kott | 126/30 |
| 5,037,093 | A | | 8/1991 | Roark | 273/1.5 R |
| 5,039,043 | A | | 8/1991 | Hodge | 248/125 |
| 5,082,231 | A | * | 1/1992 | Knowles | 248/545 |
| 5,090,165 | A | | 2/1992 | Kenny | 52/165 |
| 5,112,023 | A | | 5/1992 | Sowers | 248/519 |
| 5,156,395 | A | | 10/1992 | Smith | 273/1.5 |
| 5,157,882 | A | * | 10/1992 | Soble | 52/298 |
| 5,197,819 | A | * | 3/1993 | Hughes | 404/13 |
| 5,211,393 | A | | 5/1993 | Rolffs et al. | 273/1.5 R |
| 5,316,315 | A | | 5/1994 | Roark | 273/411 |
| 5,337,989 | A | | 8/1994 | Apple | 248/519 |
| 5,417,511 | A | | 5/1995 | Warden | 403/109 |
| 5,492,429 | A | | 2/1996 | Hodges | 403/372 |
| 5,535,978 | A | | 7/1996 | Rodriguez et al. | 248/530 |
| 5,571,229 | A | | 11/1996 | Fitzsimmons et al. | 52/40 |
| 5,649,782 | A | * | 7/1997 | Frohlich et al. | 403/301 |
| 5,752,349 | A | | 5/1998 | Fitzsimmons et al. | 52/165 |
| 5,869,151 | A | | 2/1999 | Chong | 428/18 |
| 5,901,525 | A | | 5/1999 | Dperinger et al. | 52/736.4 |
| 5,913,778 | A | | 6/1999 | Hying et al. | 52/40 |
| 6,041,559 | A | | 3/2000 | Schickert et al. | 52/165 |
| 6,098,361 | A | * | 8/2000 | Roten et al. | 52/298 |

OTHER PUBLICATIONS

Goalrilla Basketball Systems, Zue Corp., 1994, 3 pgs.
Schutt Sports Group, Slam Series, 1995, 2 pgs.
Porter Athletic Equipment Company, Big Shot Kits, admitted prior art, 5 pgs.
Lifetime Products, Accessory Ground Sleeve, Model No. 0023, admitted prior art, 4 pgs.
Bison Recreational Products, Retail Basketball Poles, see especially, BA709, admitted prior art, 1 pg.
Bison Recreational Products, Product Brochure, admitted prior art, 4 pgs.

* cited by examiner

SPORTS POLE MOUNTING STRUCTURE

FIELD OF THE INVENTION

This invention relates to a sports pole mounting structure, and more particularly to an in-ground system for engaging and supporting a sports pole.

BACKGROUND OF THE INVENTION

The sport of swimming has made pools an integral element of school sporting structures, recreational centers, and exercise gyms. Likewise, spending time in the water for exercise, relaxation, and play has made the pool extremely popular for the backyard or home. Recreational pool users play all manner of sports and games in the water and in addition to games like tag, many traditionally land based games are now played in a water environment. In particular, both volleyball and basketball have become popular sports to play while enjoying friendly company and the pool environment.

Unfortunately, sports poles, not a typical feature of a pool, are required to support the necessary equipment for both basketball and volleyball. Traditionally, sports pole mounting structures consisted of a pole permanently anchored in the ground using concrete or another such suitable material. While the traditionally anchored sports pole provided a safe sturdy goal or net, a permanent sports goal does not fit well with the general multipurpose pools of the modern home or backyard. Particularly for pools used for entertaining, a permanent sports pole would be a serious obstruction, both unpleasant to the eye and difficult to maneuver around during parties or social events.

In-ground sleeve mountings have attempted to solve this problem of permanent sports pole mounting. However, most sleeve mounting structures do not work with existing in-ground sleeves and more importantly may require expensive and specially shaped and designed sports poles to engage the sleeves.

Movable sport structures allow a person to move a sports pole from one place to another without the need of in-ground support. A popular example of a movable sport structure is the rolling basketball goals. Unfortunately, the rolling basketball goals are usually big and bulky and require significant ballast in the base structure to stabilize the sports pole. Their difficulty of movement and size has made the movable sport structure problematic for use in tight spaces or areas with little available room for ballast behind the sports pole, a typical scenario surrounding a pool.

Therefore, the pool environment presents a sports pole with some special problems. The traditionally anchored sports pole provides a safe sturdy pole but is unpleasant to the eye and difficult to maneuver around. The movable basketball goal provides the possibility of relocation during social events but the danger of a movable sports structure rolling into the pool during use or relocation presents a special concern for swimmers. Furthermore, movable sport structures are useless around pools surrounded by limited space or uneven terrain.

In light of the forgoing, there is a need for a sports pole mounting structure for use around a pool that is economic, secure and removable.

SUMMARY OF THE INVENTION

Accordingly, the present invention is directed to a sports pole mounting structure that substantially obviates one or more of the problems arising from the limitations and disadvantages of the related art.

The object and purpose of the present invention is to provide a mounting structure for removably supporting a sports pole.

Another object and purpose of the present invention is to provide a mounting structure capable of utilizing inexpensive and easily designed sports poles.

Another object and purpose of the present invention is to provide a mounting structure capable of using existing in-ground sleeves.

Another object and purpose of the present invention is to provide a mounting structure for enabling insertion and removal of varying size poles.

Additional features and advantages of the invention will be set forth in the description as follows, and in part will be apparent from the description or may be learned by practice of the invention. The objectives and other advantages of the invention will be realized and attained by the methods and apparatus particularly pointed out in the written description and claims hereof together with the appended drawings.

To achieve these and other advantages, and in accordance with the purposes of the invention, as embodied and broadly described, the invention is a sports pole mounting structure that includes an in-ground sleeve with a support member and a bracket attached to a sports pole. Upon inserting the sports pole and the bracket into the in-ground sleeve, the bracket removably engages the support member of the in-ground sleeve such that the sports pole is supported and inhibited from rotating in the in-ground sleeve. A collar is positioned on the sports pole above the bracket and engages the in-ground sleeve such that the sports pole is substantially centered in the in-ground sleeve.

It is to be understood that both the foregoing general description and the following detailed description are exemplary and explanatory, and are intended to provide further explanation of the invention as claimed.

The accompanying drawings are included to provide a further understanding of the invention and are incorporated in and constitute a part of this specification. The drawings, together with the description, serve to explain the principles of the invention.

DETAILED DESCRIPTION OF PREFERRED EMBODIMENTS

Reference will now be made in detail to the present preferred embodiment of the invention, an example of which is illustrated in the accompanying drawings. The preferred embodiment is a sports pole mounting structure supporting a sports pole and a basketball goal over a pool. However, it will be obvious to one of ordinary skill in the art that the sports pole of the description is of a representative nature and that the sports pole mounting structure disclosed in this invention applies to supporting volleyball nets and other sports equipment.

Figure 1:
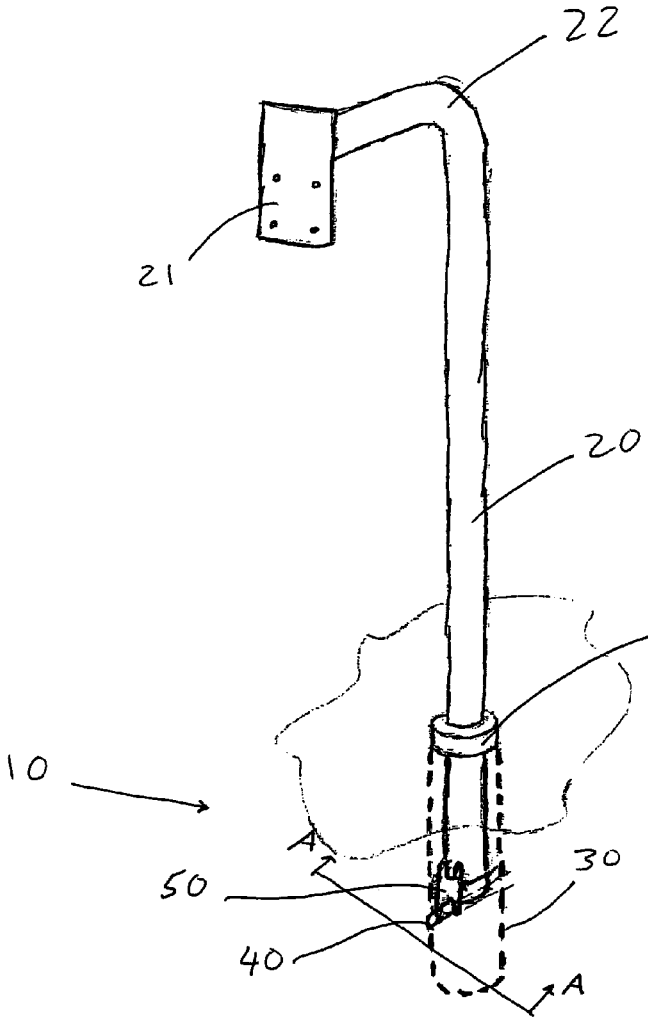
FIG. 1 is a perspective view of the sports pole mounting structure.

In the preferred embodiment, the sports pole mounting structure is shown in FIG. 1, and is designated generally by reference numeral 10. The sports pole 20 supports an attachment 21 for attaching a sporting goal. The sports pole 20 includes a curvature 22 designed to suspend the attachment 21 over the base of the sports pole 20. Note that the attachment 21 and the curvature 22 are only representative. The attachment 21 is designed to support a basketball goal but could easily be designed to support volleyball nets or any other sports apparatus. Likewise, the curvature 22 could be of any shape or even absent in order to support the desired sports apparatus properly.

In the preferred embodiment, the bracket 50 supports the sports pole 20 and the support member 40, which is supported by the in-ground sleeve 30, supports the bracket 50. The collar 60 engages both the sports pole 20 and the in-ground sleeve 30. Note that in the preferred embodiment the sports pole 20 has a circular cross section but sports poles with other cross sectional shapes would also work. By changing the cross section of the sports pole 20, the bracket 50 and the collar 60 would also be correspondingly changed to properly engage the sports pole 20.

As shown in FIG. 1, the sports pole 20 is inserted into the in-ground sleeve 30 such that the bracket 50 rests on the support member 40. The collar 60 encircles the sports pole 20 and secures to the top of the in-ground sleeve 30. The collar 60 holds the sports pole 20 in the substantial center of the in-ground sleeve 30.

Note that in the preferred embodiment the cross sectional shape of the in-ground sleeve 30 matches the sports pole 20. However, so long as the sports pole 20 can be inserted into the in-ground sleeve 30 and the collar 60 can engage the in-ground sleeve 30, there is no requirement that the in-ground sleeve 30 and the sports pole 20 have the same cross sectional shape.

Figure 1A:
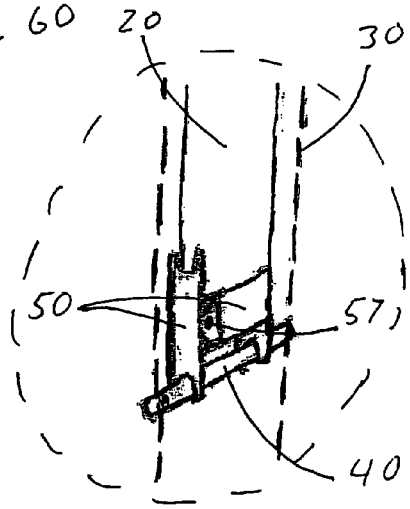
FIG. 1A is a perspective view of the sports pole mounting structure focusing on the in-ground sleeve and support bracket.

FIG. 1A illustrates the support member 40 supported by the in-ground sleeve 30 and engaged to the bracket 50. The bracket 50 is shown secured around the sports pole 20 and supporting the sports pole 20 by engaging and resting on the support member 40. The bracket 50 inhibits the rotation of the sports pole 20 by engaging the support member 40 such that the support member 40 is received within the space 55 shown in FIG. 4. In the preferred embodiment, the support member 40 is shown as a cylindrical member spanning the interior of the in-ground sleeve 20 but any cross sectional shape of the support member 40 would be sufficient provided that the support member 40 engages the space 55.

Figure 2:
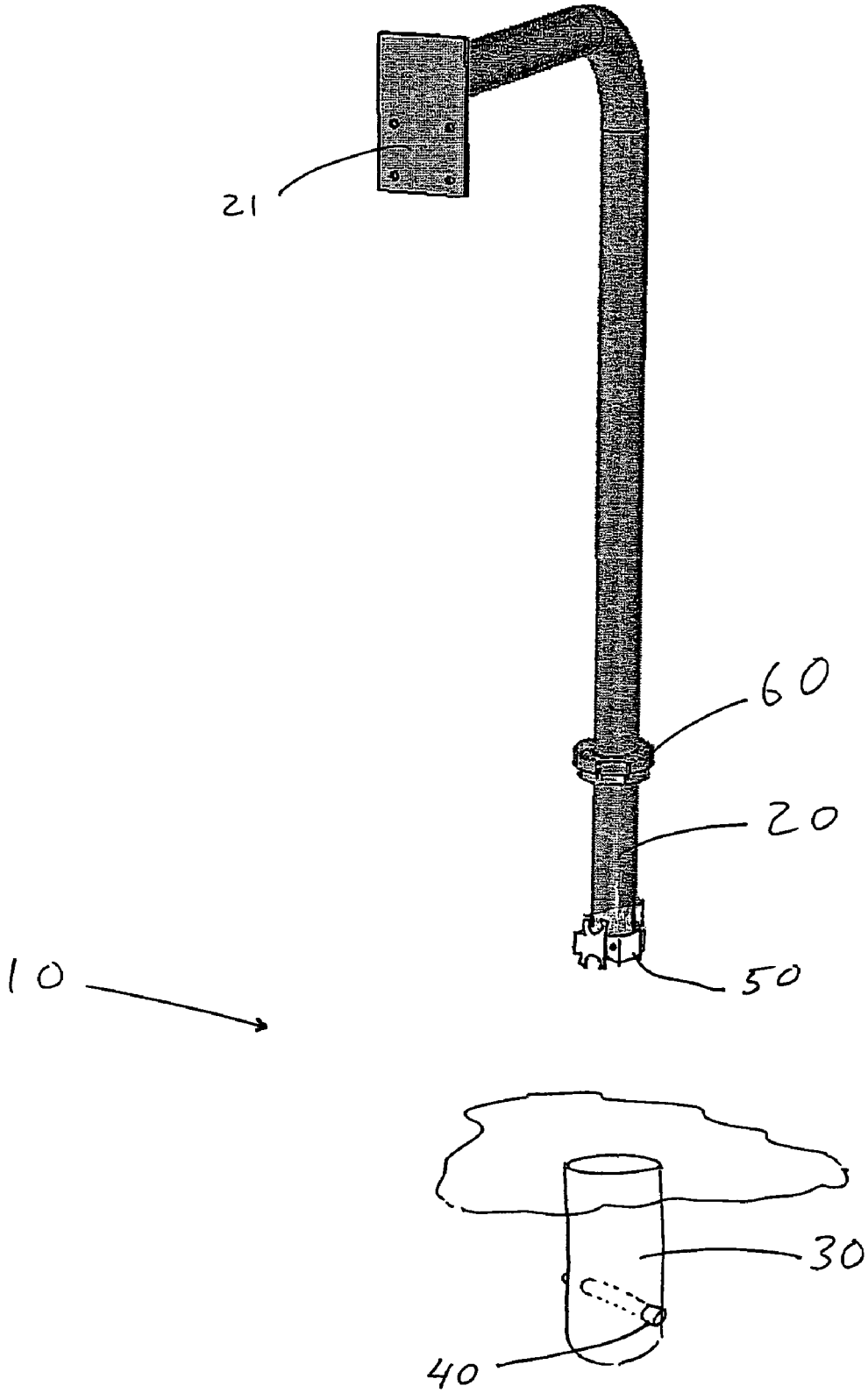
FIG. 2 is a perspective view of the sports pole mounting structure.

FIG. 2 shows the sports pole 20 removed from the in-ground sleeve 30. Upon inserting the sports pole 20 into the in-ground sleeve 30, the bracket 50 must be aligned with the support member 40 in order to engage the support member 40 in the described manner.

Figure 3:
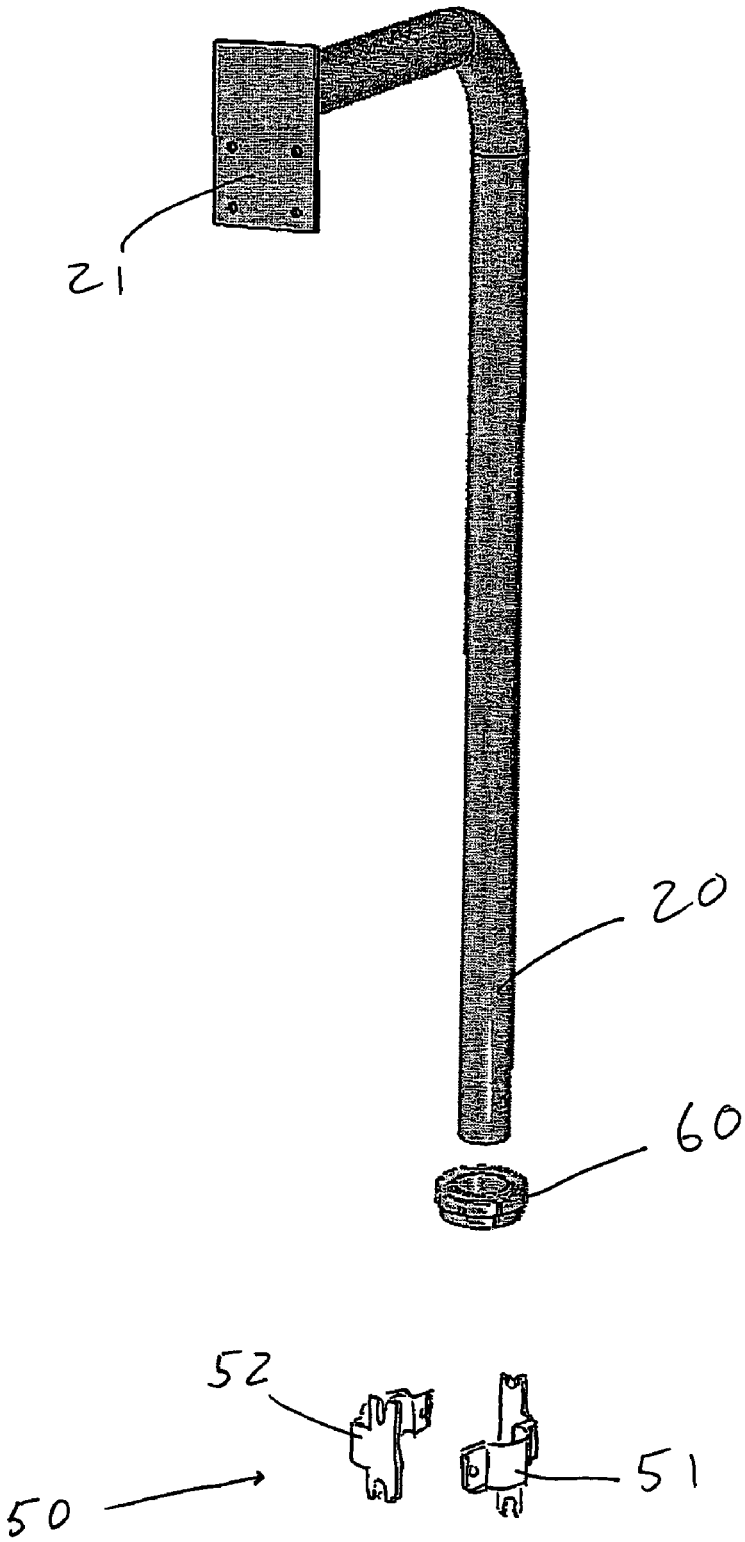
FIG. 3 is an exploded perspective view of the sports pole, the collar and the bracket.

FIG. 3 illustrates the assembly of the sports pole 20, the collar 60, and the bracket 50. The collar 60 is positioned on the sports pole 20 above the bracket 50, which is secured around the bottom of the sports pole 20 by fastening the first piece 51 to the second piece 52 of the bracket 50.

Figure 4:
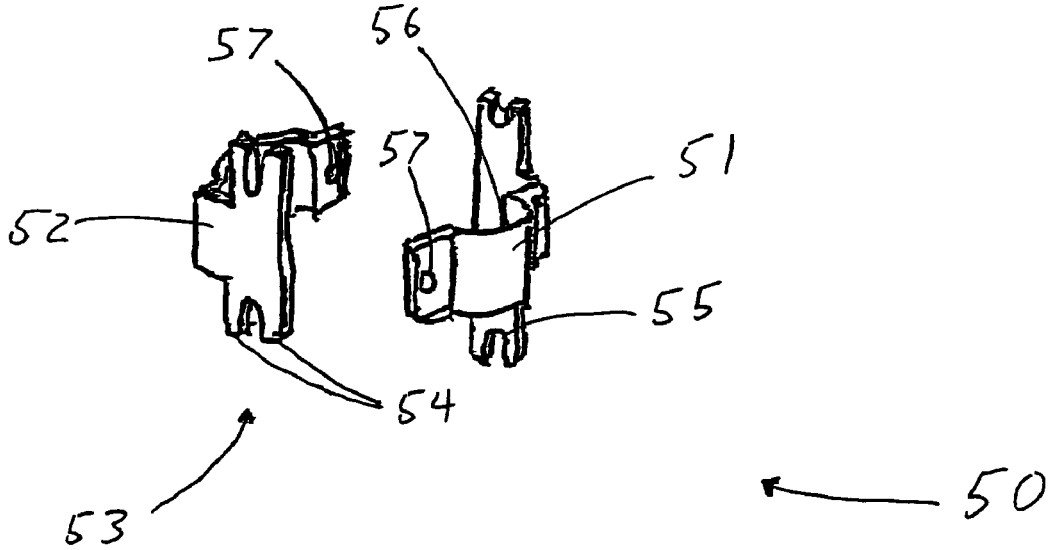
FIG. 4 is a perspective view of the first piece and second piece of the bracket.

FIG. 4 illustrates the details of the first piece 51 and the second piece 52 of the bracket 50. The first piece 51 and the second piece 52 each include a band section 56 for encircling the sports pole 20. Note that in the preferred embodiment, the band section 56 is shaped to engage a sports pole 20 with a circular cross section but the band section 56 could be shaped to engage any cross section shape of the sports pole 20.

Preferably, the sports pole 20 does not extend below the bottom of the band section 56 once the bracket 50 has been secured around the sports pole 20. In order to secure the first piece 51 and the second piece 52 together, fastener holes 57 have been provided. It will be obvious to one or ordinary skill the art to fasten the first piece 51 to the second piece 52 by any number of different fasteners.

Each of the first piece 51 and the second piece 52 includes an engagement member 53 extending below the band section 56. This extension provides that the engagement member 53 engages and rests on the support member 40 rather than the sports pole 20 resting on the support member 40. Preferably, the engagement member 53 includes a first protrusion 54 and a second protrusion 54, which are separated to create a space 55. The space 55 receives the support member 40 between the first protrusion 54 and the second protrusion 54.

Figure 5:
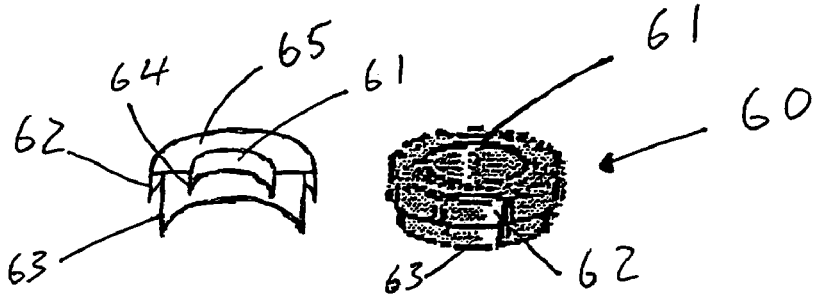
FIG. 5 is a perspective view of the collar and a cut-away view of the collar.

FIG. 5 illustrates the details of the collar 60. The collar 60 has an aperture 61 for securely receiving the sports pole 20 and the inner lip 64, which extends downward from the upper surface 65, creates the aperture 61. The collar 60 also has a middle lip 63 and an outer lip 62, both of which also extend downward from the upper surface 65 of the collar 60.

In the preferred embodiment, the collar 60 receives the sports pole 20 through the aperture 61 and also engages the in-ground sleeve 30 by receiving the top of the in-ground sleeve 30 between the middle lip 63 and the outer lip 62 of the collar 60. While the collar 60 covers the in-ground sleeve 30 and keeps out debris, the collar 60 could be but is not designed to be water tight in the preferred embodiment.

Figure 6:
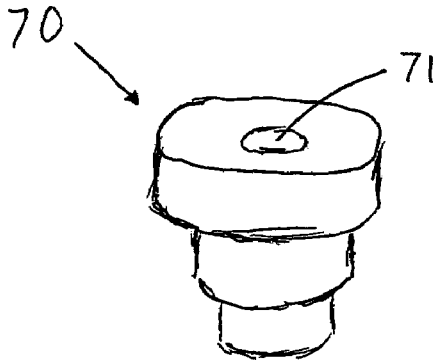
FIG. 6 is a perspective view of an alternative collar.
Figure 7:
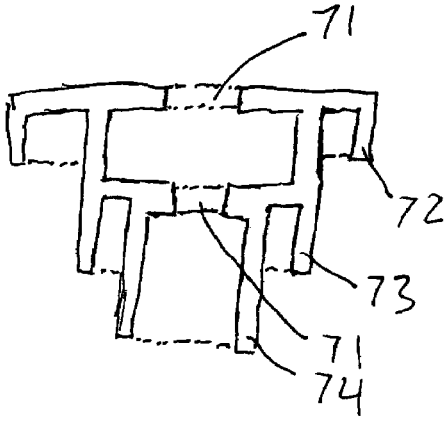
FIG. 7 is a cut-away view of the collar of FIG. 6.

FIG. 6 and FIG. 7 illustrate an alternative collar 70, which is engageable with three different sized ground sleeves. The collar 70 has an aperture 71 and three outer lips 72, 73, and 74 as shown in the cross-section view of collar 70 in FIG. 7. The aperture 71 receives the sports pole 20 and lip 72 is engageable with a ground sleeve sized such that the lip 72 securely fits over the top of the ground sleeve. By using the other outer lips 73 and 74 in the same manner, the collar 70 can be used with several standard-size existing ground sleeves.

Figure 8:
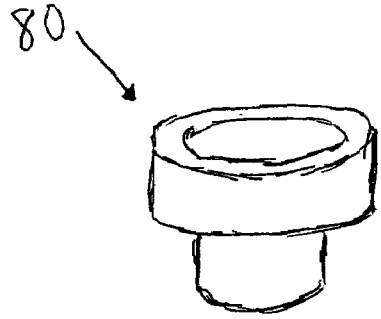
FIG. 8 is a perspective view of another alternative collar.
Figure 9:
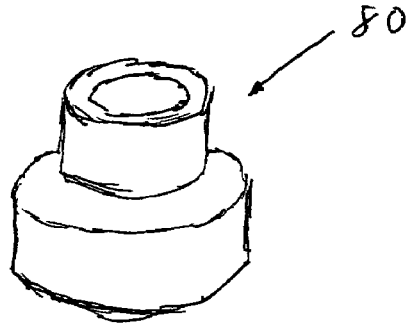
FIG. 9 is a perspective view of the collar of FIG. 8.
Figure 10:
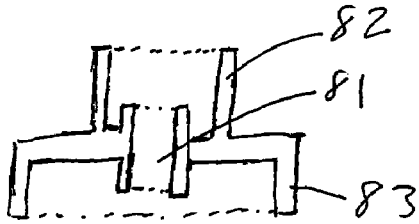
FIG. 10 is a cut-away view of the collar of FIG. 9.

FIG. 8, FIG. 9 and FIG. 10 illustrate another alternative collar 80, which engages two different sized ground sleeves and is reversible. The collar 80 has an aperture 81 for securely receiving the sports pole 20. The collar 80 also has an inner lip 82 and an outer lip 83 on opposite sides of the collar 80 as shown in the cross-section view in FIG. 10. By reversing the collar 80 on the sports pole 20, the alternative collar 80 can engage two different standard-size ground sleeves. Although FIG. 6 and FIG. 7 illustrate two alternatives to the collar 60 and show how the collar can engage different sized ground sleeves, the designs of collars 70 and 80 are in no way intended to be limiting. It would be obvious to one of ordinary skill in the art to accommodate different sized ground sleeves by any number of collar designs.

Note that in the preferred embodiment the collar 60 engages circular cross sections in both the sports pole 20 and the in-ground sleeve 30, the aperture 61, the outer lip 62 and the middle lip 63 could be shaped to accommodate any cross sectional shape of both the sports pole 20 and the in-ground sleeve 30.

In practice, the sports pole 20 is inserted into the in-ground sleeve 30 and the bracket 50 engages the support member 40 such that the sports pole 20 is rotationally inhibited with respect to the support member 40. The collar 60 provides lateral support between the sports pole 20 and the in-ground sleeve 30 and centers the sports pole 20 substantially in the in-ground sleeve 30. In the preferred embodiment, the first protrusion 54 and the second protrusion 54 on each of the engagement members 53 inhibit the rotation of the sports pole by engaging the support member 40 within the space 55 on each engagement member 53 as shown in FIG. 1A.

In the preferred embodiment, four protrusions 54 are used to inhibit the rotation of the sports pole 20. However, it will be obvious to one of ordinary skill in the art to inhibit the rotation of the sports pole 20 using only two or three protrusions.

It will be apparent to those skilled in the art that various modifications and variations can be made in the sports pole mounting structure of the present invention without departing from the spirit and scope of the invention. Thus, it is intended that the present invention cover modifications and variations of this invention provided they come within the scope of the appended claims and their equivalents.

What is claimed is:

1. A system comprising:

a sports pole having a first end and a second end;

a basketball goal attached to the first end of said sports pole; and a mounting structure attached to the second end of said sports pole, said mounting structure comprising:

a ground sleeve, said ground sleeve configured to be mounted in the ground;

a support member mounted within said ground sleeve such that said support member is positioned below the surface of the ground;

a bracket attachable to the second end of said sports pole and engageable with said support member to support said sports pole and inhibit rotation of said sports pole when the second end of said sports pole is inserted into said ground sleeve; and a collar having an aperture and at least one engagement section, the collar receiving the second end of said sports pole through the aperture and the collar being positionable on said sports pole above said bracket such that the at least one engagement section is engageable with said ground sleeve;

wherein said bracket includes a first protrusion and a second protrusion, the first protrusion and the second protrusion being positioned to receive said support member between the first protrusion and the second protrusion and from below said bracket.

2. The system according to claim 1, wherein said bracket comprises a first piece and a second piece, the first piece and second piece are secured together around said sports pole and joined by fasteners located on opposite sides of said sports pole.

3. The system according to claim 1, wherein the first protrusion and the second protrusion extend substantially below the upper surface of said support member such that the first protrusion and the second protrusion inhibit rotation of said sports pole.

4. The system according to claim 1, wherein the collar further comprises at least two engagement sections of different sizes.

5. A system comprising:

a sports pole having a first end and a second end;

a volleyball net attached to the first end of said sports pole; and a mounting structure attached to the second end of said sports pole, said mounting structure comprising:

a ground sleeve, said ground sleeve configured to be mounted in the ground;

a support member mounted within said ground sleeve such that said support member is positioned below the surface of the sound;

a bracket attachable to the second end of said sports pole and engageable with said support member to support said sports pole and inhibit rotation of said sports pole when the second end of said sports pole is inserted into said ground sleeve; and a collar having an aperture and at least one engagement section, the collar receiving the second end of said sports pole through the aperture and the collar being positionable on said sports pole above said bracket such that the at least one engagement section is engageable with said ground sleeve;

wherein said bracket includes a first protrusion and a second protrusion, the first protrusion and the second protrusion being positioned to receive said support member between the first protrusion and the second protrusion and from below said bracket.

6. The system according to claim 5, wherein said bracket comprises a first piece and a second piece, the first piece and second piece are secured together around said sports pole and joined by fasteners located on opposite sides of said sports pole.

7. The system according to claim 5, wherein the first protrusion and the second protrusion extend substantially below the upper surface of said support member such that the first protrusion and the second protrusion inhibit rotation of said sports pole.

8. The system according to claim 5, wherein the collar further comprises at least two engagement sections of different sizes.

* * * * *